US009242342B2

(12) United States Patent
Lee et al.

(10) Patent No.: US 9,242,342 B2
(45) Date of Patent: Jan. 26, 2016

(54) MANUFACTURE AND METHOD OF MAKING THE SAME

(75) Inventors: Bo-I Lee, Sindian (TW); Huang Soon Kang, Hsinchu (TW); Chi-Ming Yang, Hsinchu (TW); Chin-Hsiang Lin, Hsinchu (TW)

(73) Assignee: TAIWAN SEMICONDUCTOR MANUFACTURING COMPANY, LTD. (TW)

( * ) Notice: Subject to any disclaimer, the term of this patent is extended or adjusted under 35 U.S.C. 154(b) by 708 days.

(21) Appl. No.: 13/420,366

(22) Filed: Mar. 14, 2012

(65) Prior Publication Data

US 2013/0244552 A1 Sep. 19, 2013

(51) Int. Cl.

| | |
|---|---|
| ***B24B 53/12*** | (2006.01) |
| ***B05D 1/12*** | (2006.01) |
| ***B24B 53/017*** | (2012.01) |

(52) U.S. Cl.

CPC ..... *B24B 53/017* (2013.01)

(58) Field of Classification Search

CPC ..... B24B 53/017; B24B 53/12; B24D 18/00; B24D 3/06

USPC ..... 451/443, 539; 51/309, 293, 298

See application file for complete search history.

(56) References Cited

U.S. PATENT DOCUMENTS

| | | | | |
|---|---|---|---|---|
| 4,119,500 | A * | 10/1978 | Ishizuka et al. | 205/110 |
| 4,916,869 | A * | 4/1990 | Oliver | 51/293 |
| 5,131,924 | A * | 7/1992 | Wiand | 51/293 |
| 5,250,084 | A * | 10/1993 | Lansell et al. | 51/293 |
| 5,380,390 | A * | 1/1995 | Tselesin | 156/230 |
| 5,392,982 | A * | 2/1995 | Li | 228/124.5 |
| 5,401,283 | A * | 3/1995 | Dyer et al. | 51/293 |
| 5,584,045 | A * | 12/1996 | Tanabe et al. | 428/547 |
| 5,817,204 | A * | 10/1998 | Tselesin | 156/230 |
| 6,159,087 | A * | 12/2000 | Birang et al. | 451/526 |
| 6,294,224 | B1 * | 9/2001 | Akedo et al. | 427/547 |
| 7,201,645 | B2 * | 4/2007 | Sung | 451/443 |
| 7,258,708 | B2 * | 8/2007 | Sung | 51/307 |
| 7,467,989 | B2 * | 12/2008 | Lin et al. | 451/56 |
| 7,507,267 | B2 * | 3/2009 | Hall et al. | 51/293 |
| 8,414,362 | B2 * | 4/2013 | Sung | 451/443 |
| 8,545,583 | B2 * | 10/2013 | Duescher | 51/298 |
| 2001/0043903 | A1 * | 11/2001 | D'Evelyn et al. | 423/446 |
| 2006/0073774 | A1 * | 4/2006 | Sung | 451/56 |
| 2006/0143991 | A1 * | 7/2006 | Sung | 51/307 |

(Continued)

FOREIGN PATENT DOCUMENTS

| | | |
|---|---|---|
| KR | 10-2007-0094820 | 9/2007 |
| KR | 10-2009-0078647 | 7/2009 |

(Continued)

OTHER PUBLICATIONS

Office Action dated Nov. 29, 2013 with English translation from corresponding application No. KR 10-2012-0071732.

(Continued)

*Primary Examiner* — Joseph J Hail
*Assistant Examiner* — Marc Carlson
(74) *Attorney, Agent, or Firm* — Hauptman Ham, LLP

(57) ABSTRACT

A manufacture includes a substrate, a reinforcement layer over the substrate, and abrasive particles over the substrate. The abrasive particles are partially buried in the reinforcement layer. Upper tips of the abrasive particles are substantially coplanar.

20 Claims, 5 Drawing Sheets

(56) References Cited

U.S. PATENT DOCUMENTS

| | | | | |
|---|---|---|---|---|
| 2007/0033810 | A1* | 2/2007 | Sumiya et al. | 30/165 |
| 2008/0250722 | A1* | 10/2008 | Sung | 51/295 |
| 2008/0271384 | A1* | 11/2008 | Puthanangady et al. | 51/309 |
| 2009/0145045 | A1* | 6/2009 | Sung | 51/307 |
| 2010/0028675 | A1* | 2/2010 | Gogotsi et al. | 428/402 |
| 2011/0104989 | A1* | 5/2011 | Boutaghou et al. | 451/28 |
| 2012/0060426 | A1* | 3/2012 | Puthanangady et al. | 51/309 |
| 2012/0260582 | A1* | 10/2012 | Sung | 51/309 |
| 2013/0273820 | A1* | 10/2013 | Sung | 451/443 |

FOREIGN PATENT DOCUMENTS

| | | | | |
|---|---|---|---|---|
| KR | 10-2009-0082360 | | 7/2009 | |
| TW | 200940261 | | 10/2009 | |
| WO | WO 2006/073924 | | 7/2006 | |
| WO | WO 2006073924 | A2 * | 7/2006 | |
| WO | WO 2008/036892 | | 3/2008 | |
| WO | WO 2008036892 | A1 * | 3/2008 | B24B 37/04 |
| WO | WO 2009/091140 | | 7/2009 | |
| WO | WO 2009091140 | A2 * | 7/2009 | B24B 53/007 |

OTHER PUBLICATIONS

Office Action with English Translation dated May 15, 2013 from corresponding application No. KR 10-2012-0071732.

Office Action dated May 8, 2015 from corresponding No. TW 102106643.

* cited by examiner

MANUFACTURE AND METHOD OF MAKING THE SAME

BACKGROUND

The semiconductor integrated circuit (IC) industry has experienced rapid growth. Technological advances in IC materials and design have produced generations of ICs where each generation has smaller and more complex circuits than the previous generation. However, these advances have increased the complexity of processing and manufacturing ICs and, for these advances to be realized, similar developments in IC processing and manufacturing are needed. For example, planarization technology, such as a chemical mechanical polishing (CMP) process, has been implemented to planarize a substrate or one or more layers of features over the substrate in order to remove defects on the processed surface and/or increase the resolution of a lithographic process subsequently performed thereon.

DESCRIPTION OF THE DRAWINGS

One or more embodiments are illustrated by way of examples, and not by limitation, in the figures of the accompanying drawings, wherein elements having the same reference numeral designations represent like elements throughout and wherein.

DETAILED DESCRIPTION

Figure 1A:
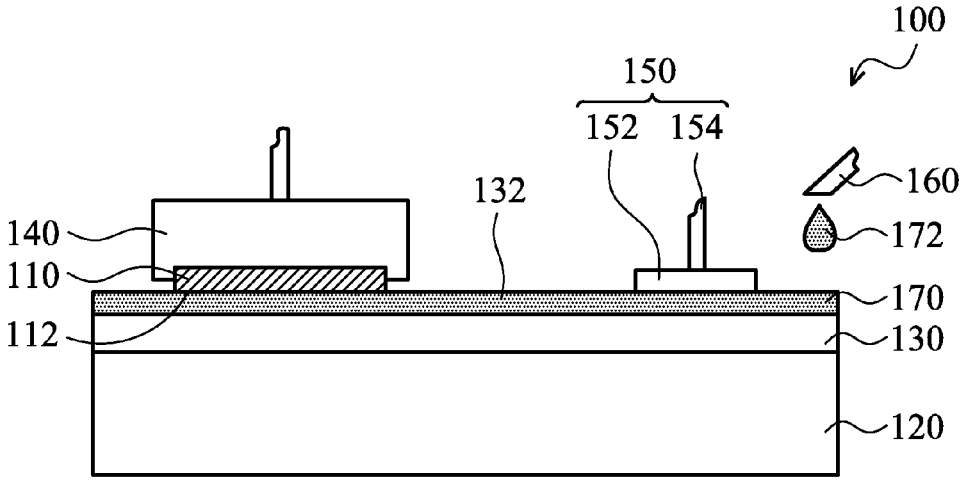
FIG. 1A is a cross-sectional view of a portion of a planarization device having a semiconductor wafer therewithin in accordance with one or more embodiments.

It is understood that the following disclosure provides many different embodiments, or examples, for implementing different features of the disclosure. Specific examples of components and arrangements are described below to simplify the present disclosure. These are, of course, examples and are not intended to be limiting. In accordance with the standard practice in the industry, various features in the drawings are not drawn to scale and are used for illustration purposes only.

The formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "lower," "upper," "horizontal," "vertical," "above," "below," "up," "down," "top," "bottom," etc. as well as derivatives thereof (e.g., "horizontally," "downwardly," "upwardly," etc.) are used for ease of the present disclosure of one features relationship to another feature. The spatially relative terms are intended to cover different orientations of the device including the features.

FIG. 1A is a cross-sectional view of a portion of a planarization device 100 having a wafer 110 therewithin in accordance with one or more embodiments. The planarization device 100 includes a platform 120, a planarization pad 130 on the platform 120, a wafer holder 140 over the platform 120 and holding the wafer 110, a pad conditioner 150 over the platform 120, and a slurry dispenser 160 over the platform 120. In addition, during operation of the planarization device 100, a layer of slurry material 170 is over the planarization pad 130 and in contact with the planarization pad 130, a surface 112 of the wafer 110, and the pad conditioner 150. In some embodiments, the wafer 110 is a semiconductor wafer.

The slurry dispenser 160 delivers a slurry material 172 onto an upper surface 132 of the planarization pad 130 to form the layer of slurry material 170. In some embodiments, the layer of slurry material 170 includes a solution containing etchant and/or polishing grit. The upper surface 132 of the planarization pad 130 defines a reference level of flatness and supports the layer of slurry material 170. During operation of the planarization device 100, the wafer holder 140 and the planarization pad 130 are movable with respect to each other. The layer of slurry material 170 chemically etching and mechanically abrading the surface 112 of the wafer 110 in order to planarize (also being referred to as "polish") the surface 112 of the wafer 110 at a predetermined removal rate.

In some embodiments, the wafer holder 140 is rotatably mounted over the platform 120. In at least one embodiment, the platform 120 is rotatable.

The pad conditioner 150 has an abrasive member 152 mounted on a shaft 154. In some embodiments, the pad conditioner 150 is mounted over the platform 120 and rotatable about the shaft 154. In some embodiments, the upper surface 132 of the planarization pad 130 is prepared to have a predetermined range of roughness. However, during operation of the planarization device 100, the upper surface 132 of the planarization pad 130 becomes smoother. In order to keep the roughness of the upper surface 132 within the predetermined range, the abrasive member 152 is usable to scratch the upper surface 132 of the planarization pad 130 in order to maintain the roughness of the upper surface 132 and to remove any residues formed on the upper surface 132.

In some embodiments, the reconditioning of the upper surface 132 of the planarization pad 130 is performed during the polishing of the surface 112 of the wafer 110 or after the polishing of the surface 112.

Figure 1B:
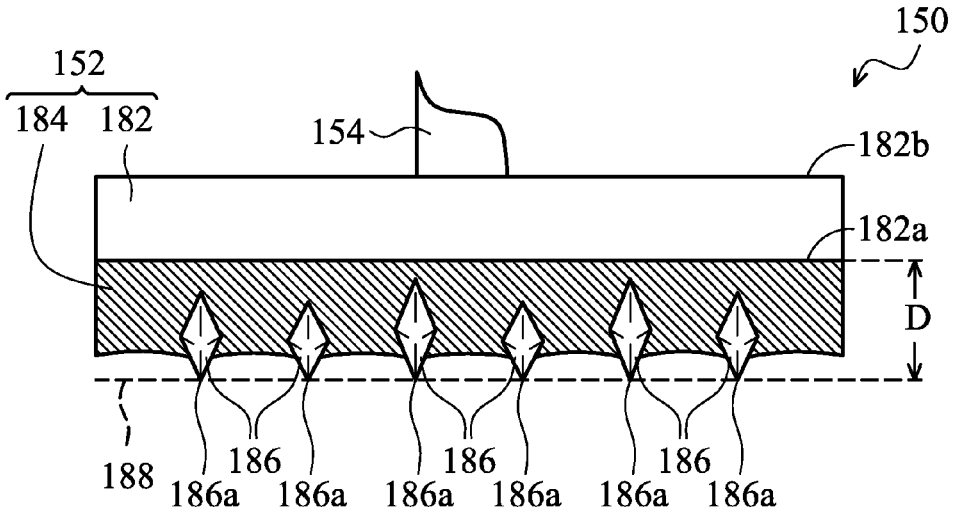
FIG. 1B is a cross-sectional view of the pad conditioner depicted in FIG. 1A in accordance with one or more embodiments.

FIG. 1B is a cross-sectional view of the pad conditioner 150 depicted in FIG. 1A in accordance with one or more embodiments. The pad conditioner 150 has an abrasive member 152 mounted on a shaft 154. The abrasive plate 152 has a substrate 182 having a first surface 182*a* and a second surface 182*b*, a reinforcement layer 184 on the first surface 182*a* of the substrate 182, and abrasive particles 186 partially buried in the reinforcement layer 184. The second surface 182*b* is usable for mounting the abrasive plate 152 to the shaft 154. Tips 186*a* of the abrasive particles 186 are substantially coplanar and define an imaginary conditioning surface 188. In some embodiments, distances between the tips 186*a* and the conditioning surface 188 range from 0% to 2% of a distance D between the conditioning surface 186 and the first surface 182*a* of the substrate 182. In some embodiments, distances between the tips 186*a* and the conditioning surface 188 range from 0% to 0.05% of the distance D.

In some embodiments, the distance D between the conditioning surface 186 and the first surface 182*a* equals the average distance between the tips 186*a* of the abrasive particles 186 and the first surface 182*a* of the substrate 182. In some embodiments, the distance D between the conditioning surface 188 and the first surface 182*a* of the substrate 182 ranges from 200 μm to 350 μm. In some embodiments, a difference between a greatest one and a least one of distances between the tips 186*a* and the conditioning surface 188 are no greater than 1 μm.

In some embodiments, the substrate 182 comprises a metallic material. In at least one embodiment, the metallic material is stainless steel. In some embodiments, the reinforcement layer 184 comprises cobalt, nickel, or solder.

In some embodiments, the abrasive particles 186 comprise a magnetic material, and thus are attractable by a magnetic force. In some embodiments, the abrasive particles 186 comprise ferromagnetic materials or paramagnetic materials. In at least one embodiment, the abrasive particles 186 are diamonds comprising a ferromagnetic material. In some embodiments, the ferromagnetic material comprises cobalt, iron, or nickel.

In some embodiments, the substrate 182 is circular or symmetrically polygonal. In some embodiments, the abrasive particles 186 are evenly distributed within a conditioning region defined on the first surface 182*a* of the substrate 182. In some embodiments, the conditioning region is a donut shape region or a circular shape region. In at least one embodiment, the conditioning region includes the entire first surface 182*a* of the substrate 182. In at least one embodiment, the substrate 182 has an asymmetrical shape.

Figure 2:
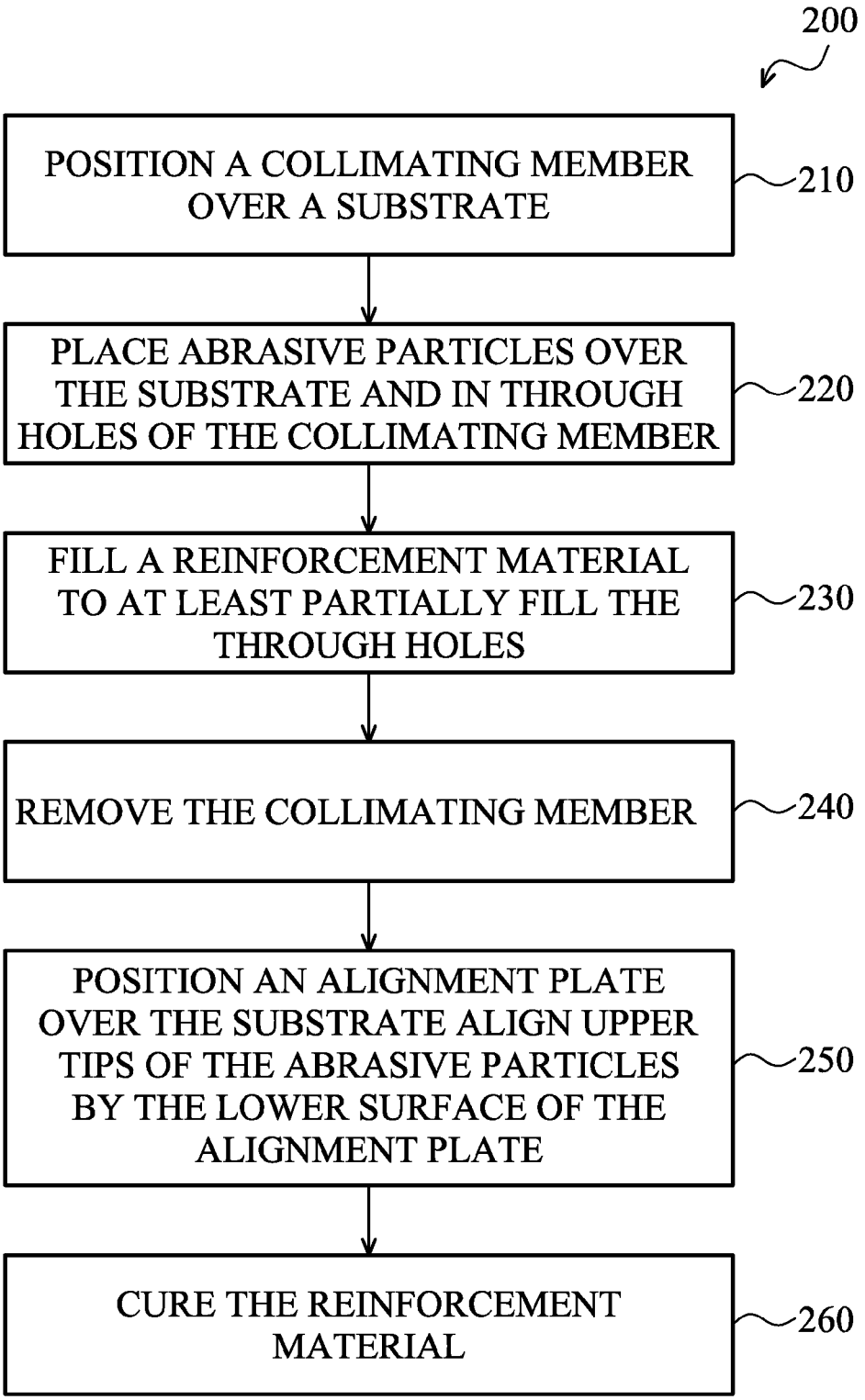
FIG. 2 is a flow chart of a method of making an abrasive plate in accordance with one or more embodiments.

FIG. 2 is a flow chart of a method 200 of making an abrasive plate (such as the abrasive plate 152 in FIGS. 1A and 1B) in accordance with one or more embodiments. FIGS. 3A-3G are cross-sectional views of an abrasive plate 300 at various manufacturing stage in accordance with one or more embodiments. In some embodiments, the abrasive plate 300 is usable as the abrasive member 152 in FIG. 1A and FIG. 1B. Compared with the abrasive plate 152 in FIG. 1B, the abrasive plate 300 is depicted in an upside down position in order to facilitate the understanding of the embodiments. It is understood that additional processes may be performed before, during, and/or after the method 200 depicted in FIG. 2, and that some other processes may only be briefly described herein.

Figure 3A:
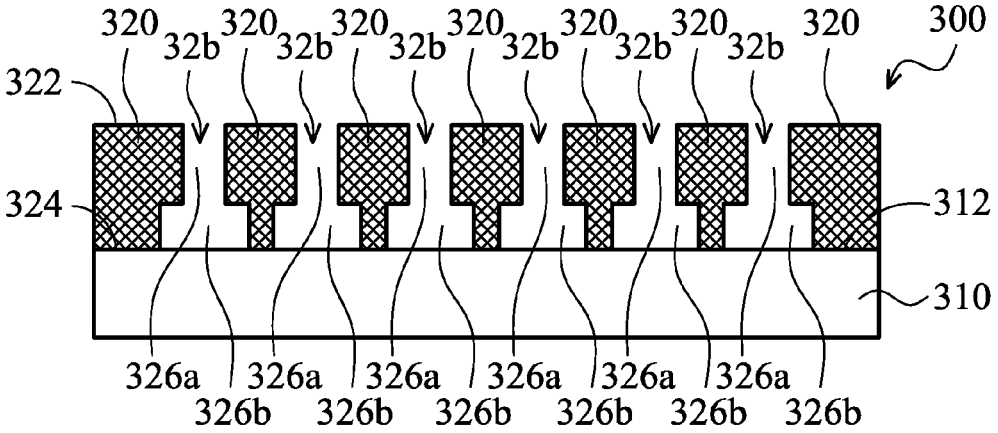
FIGS. 3A-3G are cross-sectional views of an abrasive plate at various manufacturing stages in accordance with one or more embodiments.

As depicted in FIG. 2 and FIG. 3A, in operation 210, a substrate 310 is provided for forming the abrasive plate 300, and a collimating member 320 is positioned over the substrate 310. The collimating member 320 has an upper surface 322, a lower surface 324, and through holes 326 defined therein and exposing portions of an upper surface 312 of the substrate 310. The lower surface 324 of the collimating member 320 is placed adjacent to the upper surface 312 of the substrate 310. Each of the through holes 326 has an upper opening 326*a* at the upper surface 322 and a lower opening 326*b* at the lower surface 324, and a cross-sectional area of the upper opening 326*a* is greater than that of the lower opening 326*b*. In some embodiments, the cross-sectional area of the upper opening 326*a* is equal to or less than that of the lower opening 326*b*.

Figure 3B:
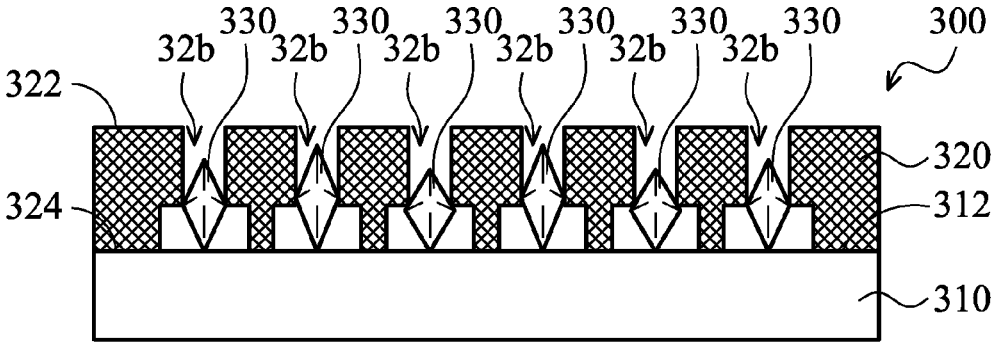

The position of the through holes 326 on the collimating member 320 is usable for defining positions of abrasive particles 330 (FIG. 3B). In some embodiments, the substrate 310 and the collimating member 320 have the same size and shape. In some embodiments, the substrate 310 and the collimating member 320 are circular or symmetrically polygonal. In some embodiments, the position of the through holes 326 is evenly distributed within a donut shape conditioning region or a circular shape conditioning region defined on the collimating member 320. In at least one embodiment, the position of the through holes 326 is evenly distributed over the entire collimating member 320.

As depicted in FIG. 2 and FIG. 3B, in operation 220, the abrasive particles 330 are placed over the upper surface 312 of the substrate 310 and in the through holes 326 of the collimating member 320. In some embodiments, only one of the abrasive particles 330 is placed in a corresponding one of the through holes 326. In at least one embodiment, the upper opening 326*a* at the upper surface 322 of the collimating member 320 are usable to align all abrasive particles 330 substantially along a direction perpendicular to a planar direction of the substrate 310. In some embodiments, the abrasive particles 330 are randomly placed on a portion of the upper surface 322 of the collimating member 320 and swept to other portion of the upper surface 322 by a brush. While being swept along the upper surface 322 of the collimating member 320, abrasive particles 330 randomly fall into the through holes 326.

In some embodiments, the abrasive particles 330 are diamonds. In some embodiments, the dimension of the diamonds ranges from 150 μm to 300 μm.

Figure 3C:
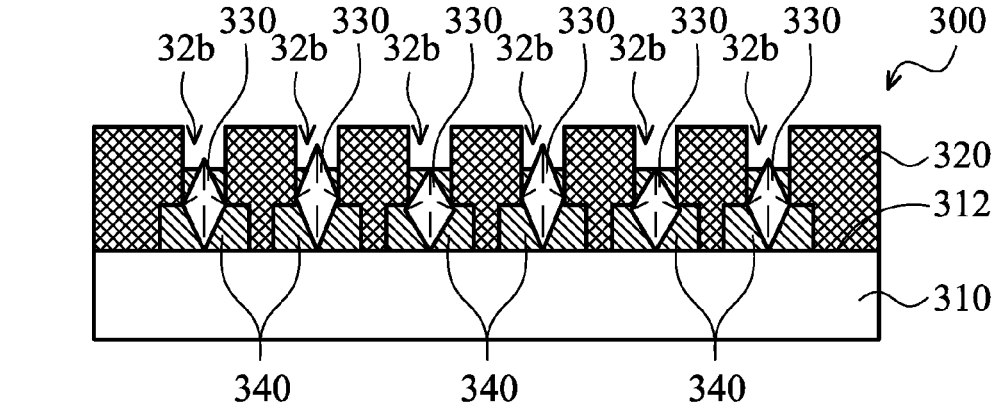

As depicted in FIG. 2 and FIG. 3C, in operation 230, a reinforcement material 340 is filled into the through holes 326 and at least partially fills the through holes 326. In some embodiments, the reinforcement material 340 is a paste or a gel that is subject to deformation upon external forces or pressures. In some embodiments, the reinforcement material 340 includes a paste containing cobalt, or nickel. In some embodiments, the reinforcement material 340 is a solder paste including tin and/or silver.

In some embodiments, the reinforcement material 340 is first placed on a portion of the upper surface 322 of the collimating member 320 and subsequently swept to other portions of the upper surface 322 by a blade. While being swept along the upper surface 322 of the collimating member 320, the reinforcement material 340 flows into and partially fills the through holes 326.

Figure 3D:
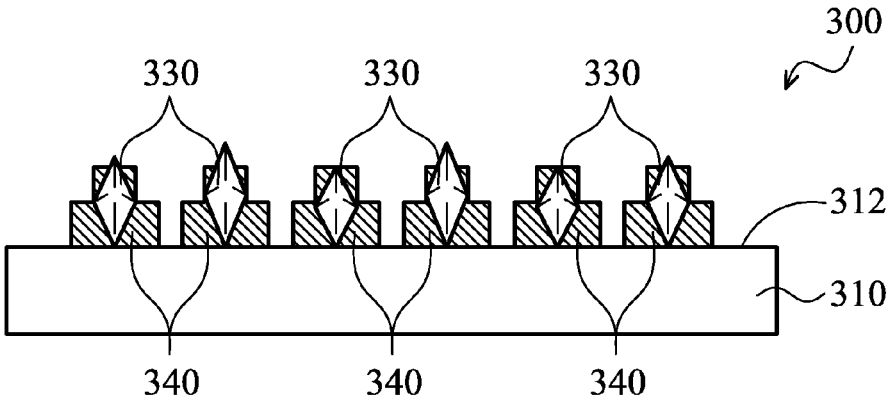
Figure 3E:
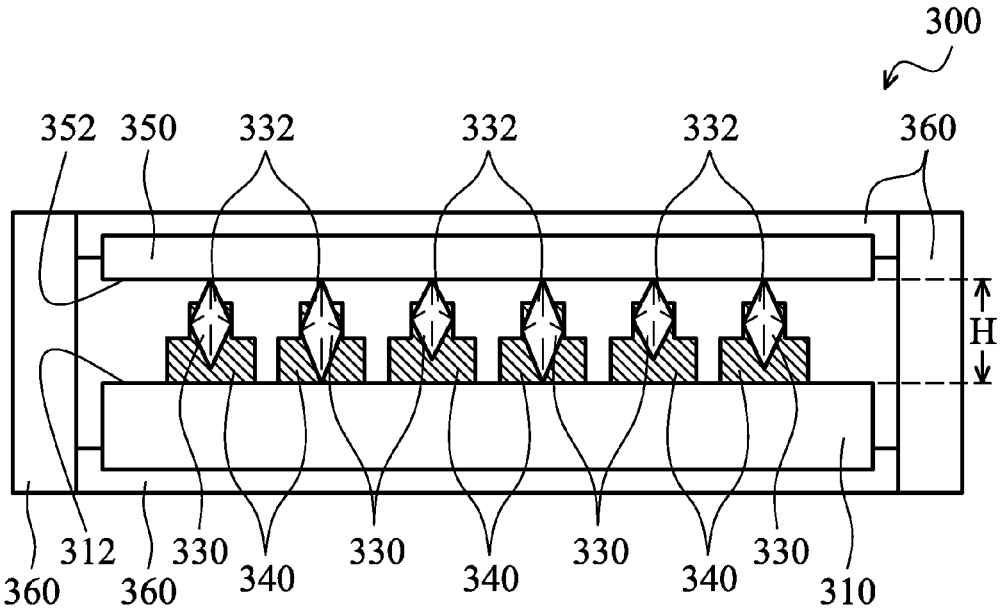

As depicted in FIG. 2 and FIG. 3D, in operation 240, the collimating member 320 is removed from the upper surface 312 of the substrate 310. As depicted in FIG. 2 and FIG. 3E, in operation 260, an alignment plate 350 is positioned over the substrate 310. The alignment plate 350 has a lower surface 352, and upper tips 332 of the abrasive particles 330 are aligned by using the lower surface 352 of the alignment plate 350. In some embodiments, distances of any point on the lower surface 352 to an upper surface 312 of the substrate ranging from 98% to 100% of an average vertical distance H between the lower surface 352 of the alignment plate 350 and the upper surface 312 of the substrate 310. In some embodiments, distances of any point on the lower surface 352 to an upper surface 312 of the substrate ranging from 99.95% to 100% of the average vertical distance H. In some embodiments, the distance H ranges from 200 μm to 350 μm.

In some embodiments, the alignment plate 350 is held by a clamping device 360 that also holds the substrate 310. In some embodiments, spacers are placed over the substrate 310 in order to separate the substrate 310 from the alignment plate 350 at a predetermined average distance H, and then the alignment plate 350 is placed over the spacers.

The alignment plate 350 is capable of attracting the abrasive particles 330 to allow contact between the upper tips 332 of the abrasive particles 330 and the lower surface 352 of the alignment plate 350. In some embodiments, the abrasive particles 330 were originally in contact with the upper surface 312 of the substrate 310 because of the gravity as depicted in FIG. 3D. The alignment plate 350 attracts and pulls the abrasive particles 330 upward to align the upper tips 335 of the abrasive particles 330.

In some embodiments, the abrasive particles 330 comprise a magnetic material and are attractable by a magnetic force, and the attraction of the abrasive particles 330 is performed by using the magnetic force. In at least one embodiment, the alignment plate 350 is a magnet, and the abrasive particles 330 are diamonds having ferromagnetic impurities such as cobalt, iron, or nickel.

Figure 3F:
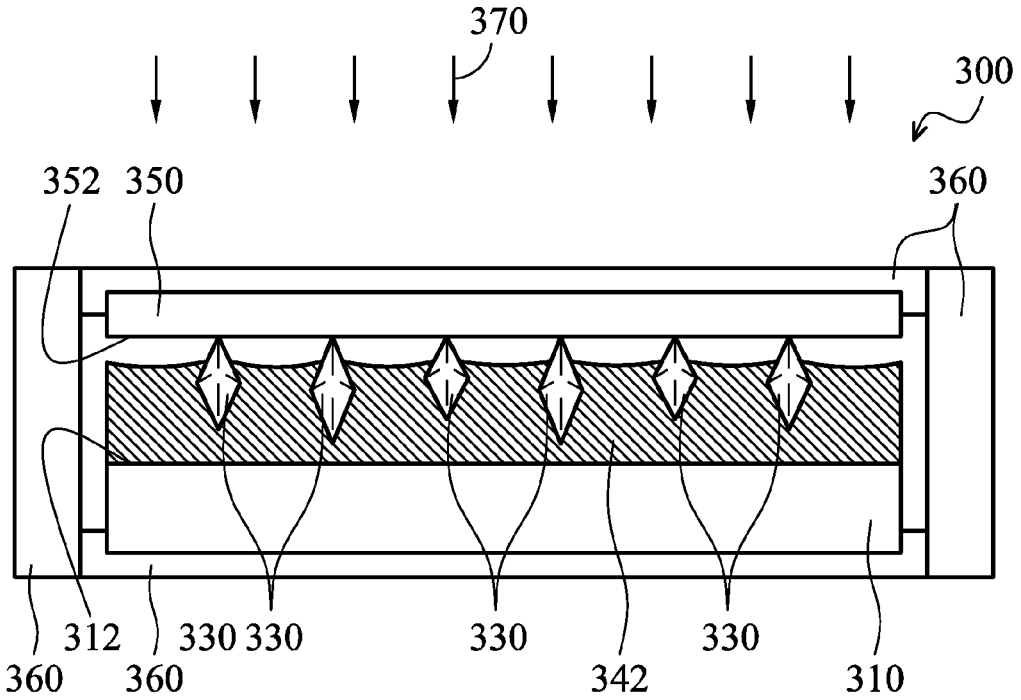

As depicted in FIG. 2 and FIG. 3F, in operation 260, a process 370 is performed to cure the reinforcement material 340 to form a layer of reinforcement material 342. In some embodiments, the process 370 includes heating the reinforcement material 340 at an environment having a temperature no less than 1000° C. In some embodiments, the process 370 includes heating the reinforcement material 340 at a predetermined temperature for a predetermined period of time that is sufficient to convert the reinforcement material 340 into a state that is rigid enough to hold the abrasive particles 330 at their respective position after being aligned based on the upper surface 312 of the substrate 310. In some embodiments, the term "cure" and "curing" also refer to "reflow" or "reflowing" the reinforcement material 340 to form the layer of reinforcement material 342.

Figure 3G:
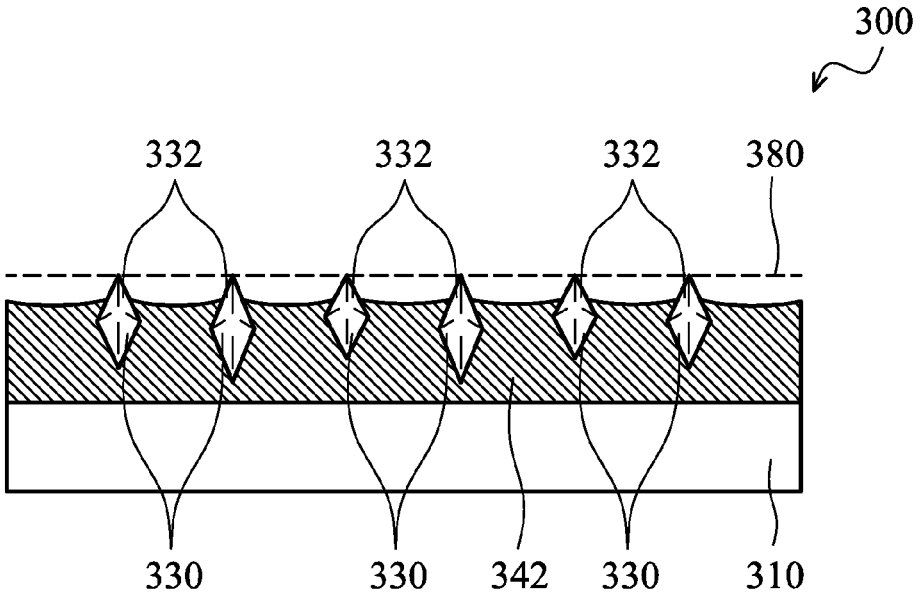

As depicted in FIG. 3G, the clamping device 360 and the alignment plate 350 are subsequently removed after the formation of the layer of reinforcement material 342. Because of the alignment performed based on the alignment plate 350, the upper tips 332 of the abrasive particles 330 are substantially coplanar along a reference plane 380, which is also referred to as a conditioning surface 380 of the abrasive plate 300. The abrasive plate 300 is usable as the abrasive plate 152 in FIG. 1B, and the relationship among the upper tips 332, the conditioning plane 380, and the substrate 310 is similar to that of the tips 186*a*, the conditioning plane 188, and the substrate 182 depicted in FIG. 1B.

In accordance with some embodiments, a manufacture includes a substrate, a reinforcement layer over the substrate, and abrasive particles over the substrate. The abrasive particles are partially buried in the reinforcement layer. Upper tips of the abrasive particles are substantially coplanar.

In accordance with some embodiments, a method of making a manufacture includes positioning a collimating member over a substrate, where the collimating member includes through holes. Abrasive particles are placed over the substrate and in the through holes of the collimating member. A reinforcement material is placed to at least partially fill the through holes. The collimating member is then removed, and an alignment plate is placed over the substrate. The alignment plate has a lower surface. Upper tips of the abrasive particles are aligned by the lower surface of the alignment plate, and the reinforcement material is cured.

In accordance with some embodiments, an abrasive member includes a substrate, abrasive particles over an upper surface of the substrate, and a reinforcement layer holding the abrasive particles and the upper surface of the substrate. The substrate has a conditioning region defined thereon. The abrasive particles are evenly distributed in the conditioning region. Upper tips of the abrasive particles defines a conditioning surface, and a difference between a greatest one and a least one of distances between the upper tips and the conditioning surface is no greater than 1 μm.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method of making a manufacture, the method comprising:

positioning a collimating member over a substrate, the collimating member comprising through holes;

placing abrasive particles over the substrate and in the through holes of the collimating member;

filling a reinforcement material to at least partially fill the through holes;

removing the collimating member;

positioning an alignment plate over the substrate, the alignment plate having a lower surface;

magnetically aligning upper tips of the abrasive particles using the lower surface of the alignment plate; and curing the reinforcement material.

2. The method of claim 1, wherein the positioning of the alignment plate comprises:

placing spacers over the substrate; and placing the alignment plate over the spacers.

3. The method of claim 1, wherein the alignment plate is so positioned that distances of any point on the lower surface to an upper surface of the substrate ranging from 99.95% to 100% of a distance between the lower surface of the alignment plate and the upper surface of the substrate.

4. The method of claim 1, wherein placement of the abrasive particles in the through holes comprises placing one of the abrasive particles in a corresponding one of the through holes.

5. The method of claim 1, wherein the alignment of the upper tips of the abrasive particles comprises attracting the abrasive particles to allow contact between the upper tips and the lower surface of the alignment plate.

6. The method of claim 5, wherein the abrasive particles comprise a magnetic material, and the attraction of the abrasive particles is performed by using a magnetic force.

7. The method of claim 1, wherein the curing of the reinforcement material comprises heating the reinforcement material at an environment having a temperature no less than 1000° C.

8. A method of making an abrasive plate, the method comprising:

filling a reinforcement material to at least partially fill through holes of a collimating member, the through holes of the collimating member being at least partially occupied by abrasive particles;

removing the collimating member;

magnetically aligning tips of the abrasive particles with respect to a planar surface facing the abrasive particles; and curing the reinforcement material.

9. The method of claim 8, wherein the reinforcement material is over a substrate, and the method further comprises:

placing spacers over the substrate; and placing the planar surface over the spacers.

10. The method of claim 8, wherein the reinforcement material is over a substrate, and the planar surface is substantially parallel to a surface of the substrate.

11. The method of claim 8, wherein each through hole is at least partially occupied by one of the abrasive particles.

12. The method of claim 8, wherein magnetically aligning the tips of the abrasive particles with respect to the planar surface comprises attracting the abrasive particles toward the planar surface, causing the tips of the abrasive particles to contact the planar surface.

13. The method of claim 8, wherein curing the reinforcement material causes the tips of the abrasive particles to define a conditioning surface.

14. The method of claim 13, wherein the reinforcement material is over a substrate, and a distance between the conditioning surface and a surface of the substrate ranges from about 200 micrometers to about 350 micrometers.

15. The method of claim 8, wherein the abrasive particles are diamonds.

16. The method of claim 15, wherein the diamonds comprise magnetic material impurities.

17. The method of claim 8, wherein the reinforcement material is over a substrate, and magnetically aligning the tips of the abrasive particles with respect to the planar surface causes at least one of the abrasive particles to be separated from a surface of the substrate by a portion of the reinforcement material.

18. A method, comprising:

placing abrasive particles over a substrate and within through holes of a collimating member;

depositing a reinforcement material into the through holes;

removing the collimating member;

positioning an alignment surface over the substrate;

magnetically aligning tips of the abrasive particles with the alignment surface; and curing the reinforcement material.

19. The method of claim 18, wherein depositing the reinforcement material comprises depositing one or more of cobalt, nickel or solder into the through holes of the collimating member.

20. The method of claim 18, wherein the abrasive particles comprise a magnetic material, and the magnetic alignment of the tips of the abrasive particles is caused by a magnetic force provided by the alignment surface.

* * * * *

UNITED STATES PATENT AND TRADEMARK OFFICE

CERTIFICATE OF CORRECTION

PATENT NO. : 9,242,342 B2
APPLICATION NO. : 13/420366
DATED : January 26, 2016
INVENTOR(S) : Bo-I Lee et al.

It is certified that error appears in the above-identified patent and that said Letters Patent is hereby corrected as shown below:

Title page, item (72), the Inventors should read as follows:

Bo-I LEE, Sindian (TW);
Soon Kang HUANG, Hsinchu (TW);
Chi-Ming YANG, Hsinchu (TW);
Chin-Hsiang LIN, Hsinchu (TW)

Signed and Sealed this
Twenty-sixth Day of April, 2016

Michelle K. Lee

Michelle K. Lee
*Director of the United States Patent and Trademark Office*